United States Patent [19]

Voegeli

[11] Patent Number: 4,544,081

[45] Date of Patent: Oct. 1, 1985

[54] NEWSPAPER DISPLAY MACHINE

[76] Inventor: Ronald C. Voegeli, 918 Gibbs Rd., Venice, Fla. 33595

[21] Appl. No.: 530,788

[22] Filed: Sep. 9, 1983

[51] Int. Cl.[4] ..... G07F 11/04

[52] U.S. Cl. ..... 221/155; 194/1 B

[58] Field of Search ..... 194/1 A, 1 B, 51, 59, 194/65; 221/155, 210, 213, 231, 232, 244; 312/234, 101, 185, 188, 190, 138 A, 138 R; 358/254; 455/90, 128; 220/75, DIG. 13

[56] References Cited

U.S. PATENT DOCUMENTS

| | | | |
|---|---|---|---|
| 1,381,361 | 6/1921 | Studer | 312/185 |
| 2,802,487 | 8/1957 | Breehl | 220/75 X |
| 3,114,475 | 12/1963 | Etes | 221/155 X |
| 3,172,386 | 3/1965 | West | 220/DIG. 13 |
| 3,747,733 | 7/1973 | Knickerbocker | 221/244 |
| 3,870,136 | 3/1975 | Voegeli . | |

*Primary Examiner*—Stanley H. Tollberg
*Attorney, Agent, or Firm*—Burns, Doane, Swecker & Mathis

[57] ABSTRACT

A newspaper display machine includes a housing, a service access door mounted on the housing and carrying a coin-actuated unlocking device, and a paper access door mounted on the service access door. A locking mechanism includes a first lock for locking the service access door to the housing and a second lock for locking the paper access door to the service access door. A single key-actuated cylinder controls both the first and second locks for selective actuation. A pin which forms a horizontal hinge axis for the paper access door also forms a vertical hinge axis for the service access door. That pin is slidably removable from the housing to facilitate removal of the service access door from the housing. That pin, together with another pin plus two elements of the second lock, serve to support the service access door against forces imposed thereagainst when the paper access door is slammed shut. A transparent paper holder is mounted on the paper access door to press upper and lower portions of a display newspaper against a window of the paper access door and thereby facilitate reading of that paper from the outside. The housing is formed to have only a single seam which is disposed on a bottom surface thereof.

29 Claims, 16 Drawing Figures

12
18
42
34
38
32
136
39
70
94
106
105
54
95
96
103
71
104
107
102
80
88
64
88
52
62
146
47
49
51
20
51

111
112
114
116
130
134
136
138
140
142
144
145
146
147
148
150
152
154
156
160
162
163
164
165
166
49
74

NEWSPAPER DISPLAY MACHINE

BACKGROUND AND OBJECTS OF THE INVENTION

The present invention relates to display machines and, in particular, to newspaper display machines of the type having one or more access doors.

Newspaper display machines include an interior compartment for housing newspapers, and a paper access door which enables newspapers to be removed from and supplied to the interior compartment. The paper access door, normally maintained in a locked condition, is unlocked in response to the depositing of proper coinage in a coin-actuated unlocking mechanism. The paper access door is often mounted upon and as part of a service access door which carries the coin-actuated unlocking mechanism. The service door can be opened to afford access to the coin-actuated unlocking mechanism for maintenance and coin collection.

It is necessary to enable authorized maintenance and paper delivery personnel to unlock the access door. In some cases, unlocking of the paper access door is achieved by the authorized personnel depositing the proper coinage. However, this requires that relatively large amounts of coins be distributed to, and carried by, the authorized personnel. In order to avoid this inconvenience, there are often provided a pair of key-operated locks on the machine which enable the paper access door and service access door to be opened independently of one another. The provision of two separately actuable locks for the access doors is costly and increases effort required to open both doors.

It is desirable that the service access door be removable from the machine housing for maintenance purposes. For that reason, the mounting of the service access door to the housing has been heretofore designed for simplified removal and insertion. However, often such a mounting is insufficient to withstand the forces imposed thereon when the spring-biased paper access door is repeatedly slammed shut. As a result, one or more of the corners of the service access door and/or paper access door can become bent.

Another common characteristic of newspaper display machines relates to the fact that the main housing is generally formed of a lower U-shaped section and an upper section of inverted U-shape. These housing sections are placed upon one another such that the downwardly depending legs of the upper section engage the upwardly extending legs of the lower section. The junctures between those legs is then welded to rigidly secure the two sections together. However, this results in the seams, or weld lines, being exposed along the sides of the housing, which seams are susceptible to rusting, especially since they are exposed to the elements. Furthermore, the seams are difficult to paint over, requiring that extra measures be taken to minimize their unsightly appearance, such as by matching the seams or pasting labels or the like over the seams. It is also difficult to align the legs of the housing sections during fabrication, thereby increasing the possibility for unevenness to occur.

A further characteristic of newspaper display machines is that the paper access door comprises a transparent window which enables a customer to view the interior of the housing. Often, a pocket formed of solid metal or a wire mesh is mounted along the inside of the window to house a folded-up display newspaper for being viewed through the window. However, the display paper may be sitting loosely behind the window and is not easily read, as the surface of the exposed page of the display paper may be rumpled or otherwise distorted (non-planar). In one case, a solid press plate is mounted at the top of a solid pocket-forming plate by means of a coil spring to bias the top of the display newspaper against the transparent window. However, this may not result in the bottom of the display newspaper being pressed in a similar manner. Also, the solid nature of these plates prevents a purchasor from viewing the interior compartment in a case where the display newspaper has not been provided or has been removed by a previous purchaser. Hence, the current purchasor cannot easily determine whether any unsold newspapers remain in the machine and may thus be dissuaded from making a purchase.

It is, therefore, an object of the present invention to minimize or obviate problems of the type discussed above.

Another object is to enable first and second doors of a display machine to be selectively opened by means of a single key-actuated cylinder.

A further object is to provide a display machine with a service access door which is easily removable and yet securely supported when mounted on the display machine housing.

Another object is to provide a novel display machine housing which eliminates the presence of multiple, exposed weld seams, and which is less subject to damage by impacts.

An additional object is to provide a display holder for holding a display paper behind a window of a paper access door while simultaneously pressing upper and lower portions of the paper against the window to make the displayed page easier to read.

A further object is to provide such a display holder which does not block a customer's view of the interior compartment.

SUMMARY OF THE INVENTION

These objects are achieved by the present invention which relates to a display machine of the type including a coin-actuated unlocking device. The display machine comprises a housing defining an interior compartment for containing articles to be sold. The housing forms a main access opening. A first door is movably mounted on the housing for opening and closing the access opening. The first door forms a secondary access opening. A first locking device locks the first door to the housing. A second door is carried by the first door and is movable relative thereto for opening and closing the secondary access opening. A second locking device locks the second door to the first door and is arranged to be unlocked in response to the insertion of appropriate coinage in the coin-actuated unlocking device. A key-actuated unlocking mechanism is mounted on the first door and is operably connected to the first and second locking devices. The key-actuated unlocking mechanism is movable between three separate positions in response to key actuation, and includes means for (i) maintaining the first and second locking devices in their locking positions, when the unlocking mechanism is in a first of three positions, (ii) means for unlocking the second locking device while maintaining the first locking device in its locking position, when the unlocking mechanism is in a second of three positions, and (iii)

means for unlocking the first locking means and maintaining the second locking means in its locking position, when the unlocking mechanism is in a third of its three positions. Preferably, the key-actuated locking mechanism includes a rotary cylinder operably connected to the first and second unlocking devices.

Preferably, the second door includes a window, and a holder is provided on an inner side of the second door for retaining a display newspaper against the window to be viewed from the outside. The holder is yieldably biased toward the window and is manually flexibly displaceable away from the window to permit a display newspaper to be positioned between the holder and the window, so that upon release of the holder, the latter rebounds toward the window to press upper and lower portions of the display newspaper thereagainst.

Preferably, the first door carries at least four projecting elements which abut against the housing at spaced locations around the periphery of the first door to resist inward forces imposed against the first door by the second door, when the latter is slammed shut by a spring.

Preferably, the housing comprises a piece of elongated sheet metal having two elongate parallel side edges and two parallel end edges interconnecting the side edges. The piece of metal is bent in four places parallel to the end edges to form a seamless top surface, and two seamless side surfaces. The end edges are welded together to form a single-seamed bottom surface. Front and back walls are secured to the bent piece of metal adjacent respective ones of the side edges.

The present invention also involves a method of forming a housing for a display machine. The method includes bending a piece of sheet metal in four places parallel to its end edges to form a seamless top surface, and two seamless side surfaces. The end edges are welded together to form a single-seamed bottom surface. Thereafter, front and back walls are attached to the piece of metal adjacent respective ones of the side edges.

THE DRAWING

The foregoing objects, advantages and features of the invention will become more readily understood when viewed together with the attached drawings and when considered with the detailed description of the invention.

Figure 6:
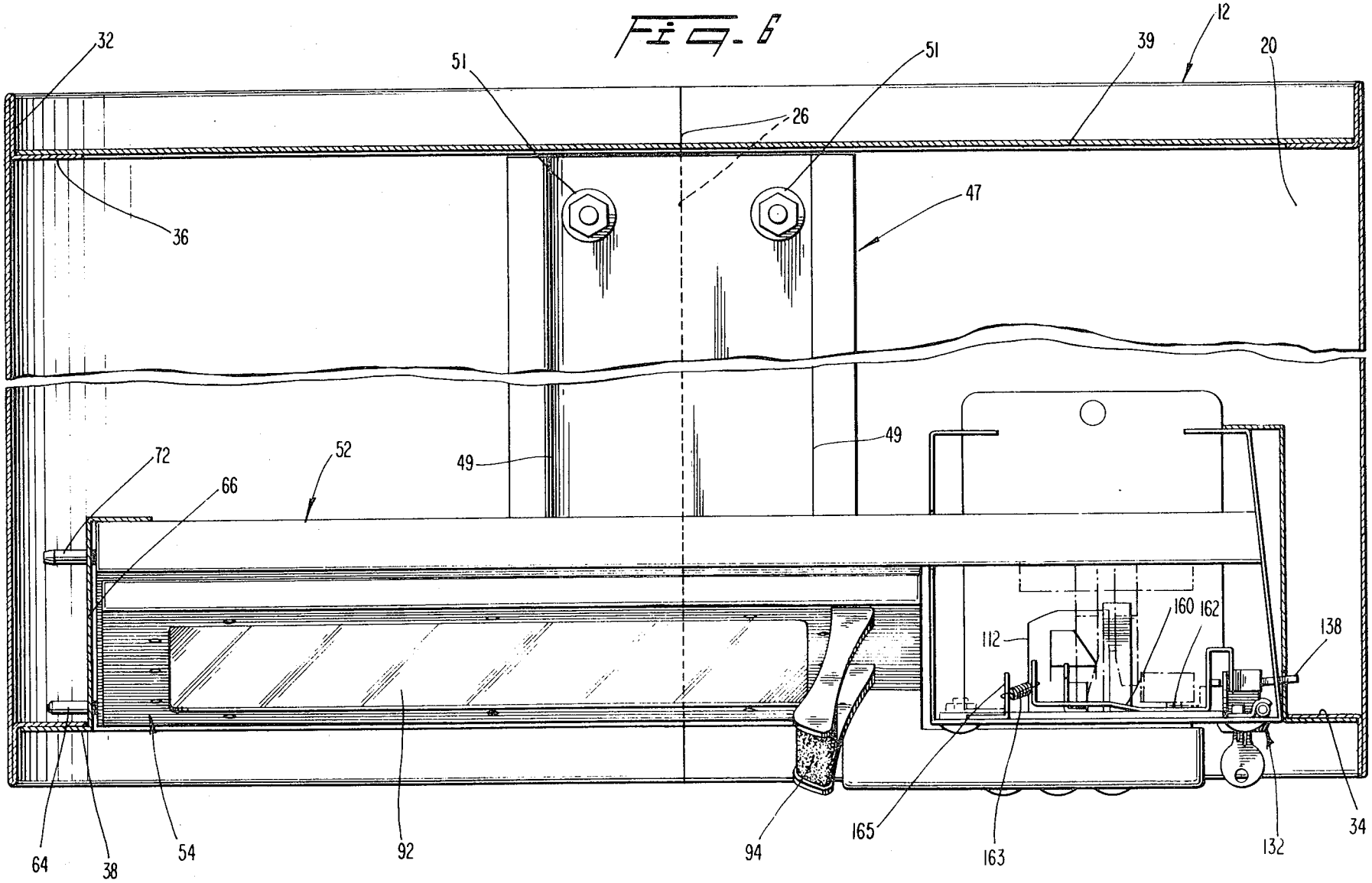
FIG. 6 is a horizontal sectional view taken through the machine housing along line 6—6 in FIG. 1.
Figure 7:
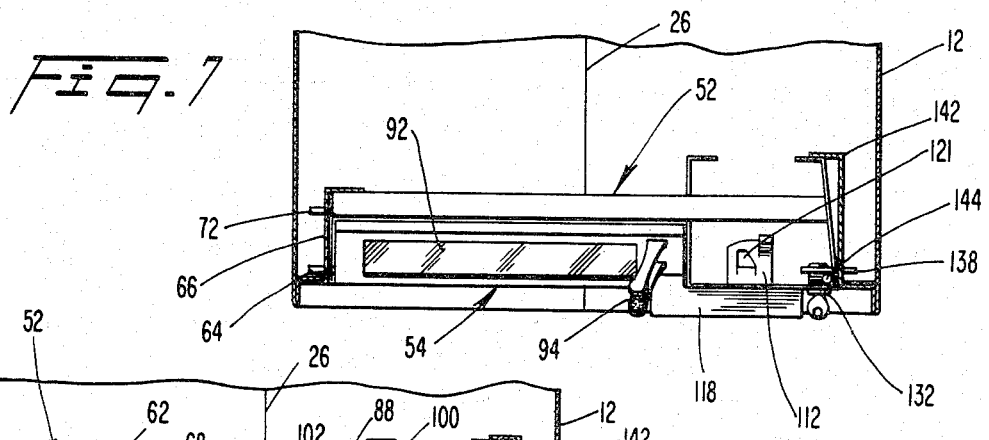
Figure 8:
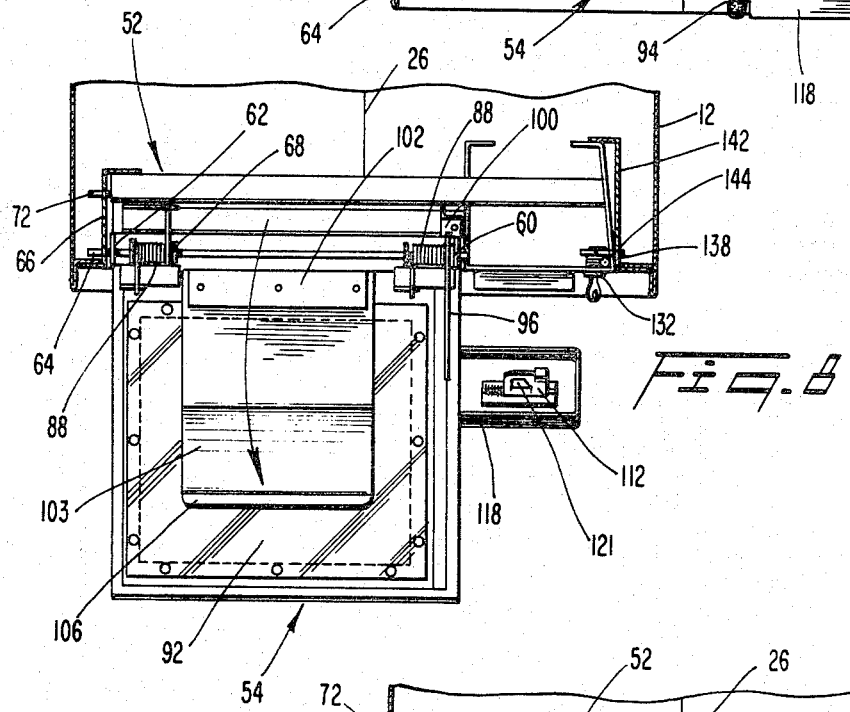
Figure 9:
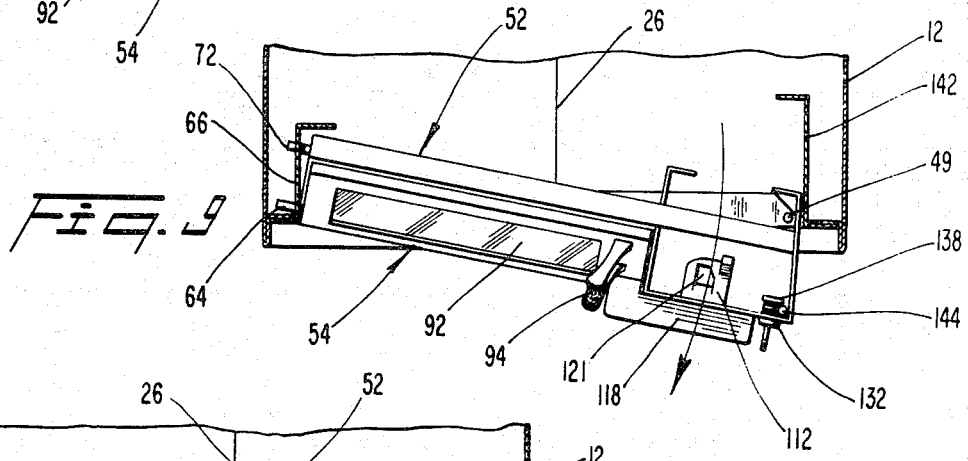
Figure 10:
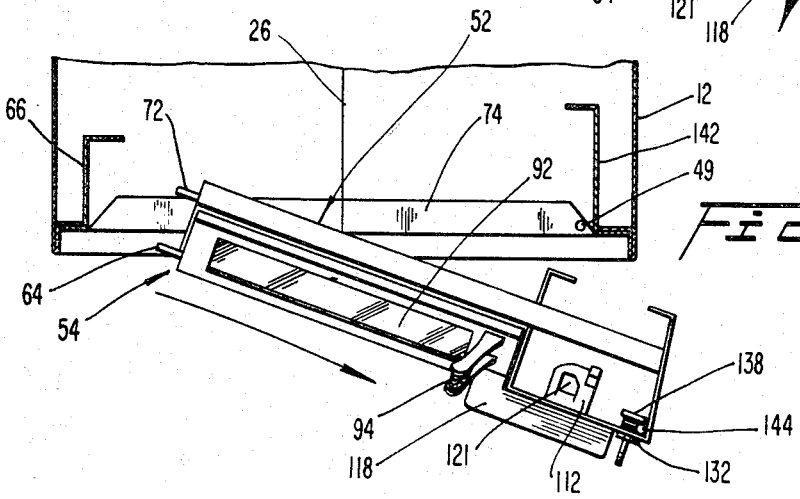
Figures 11, 12, 13:
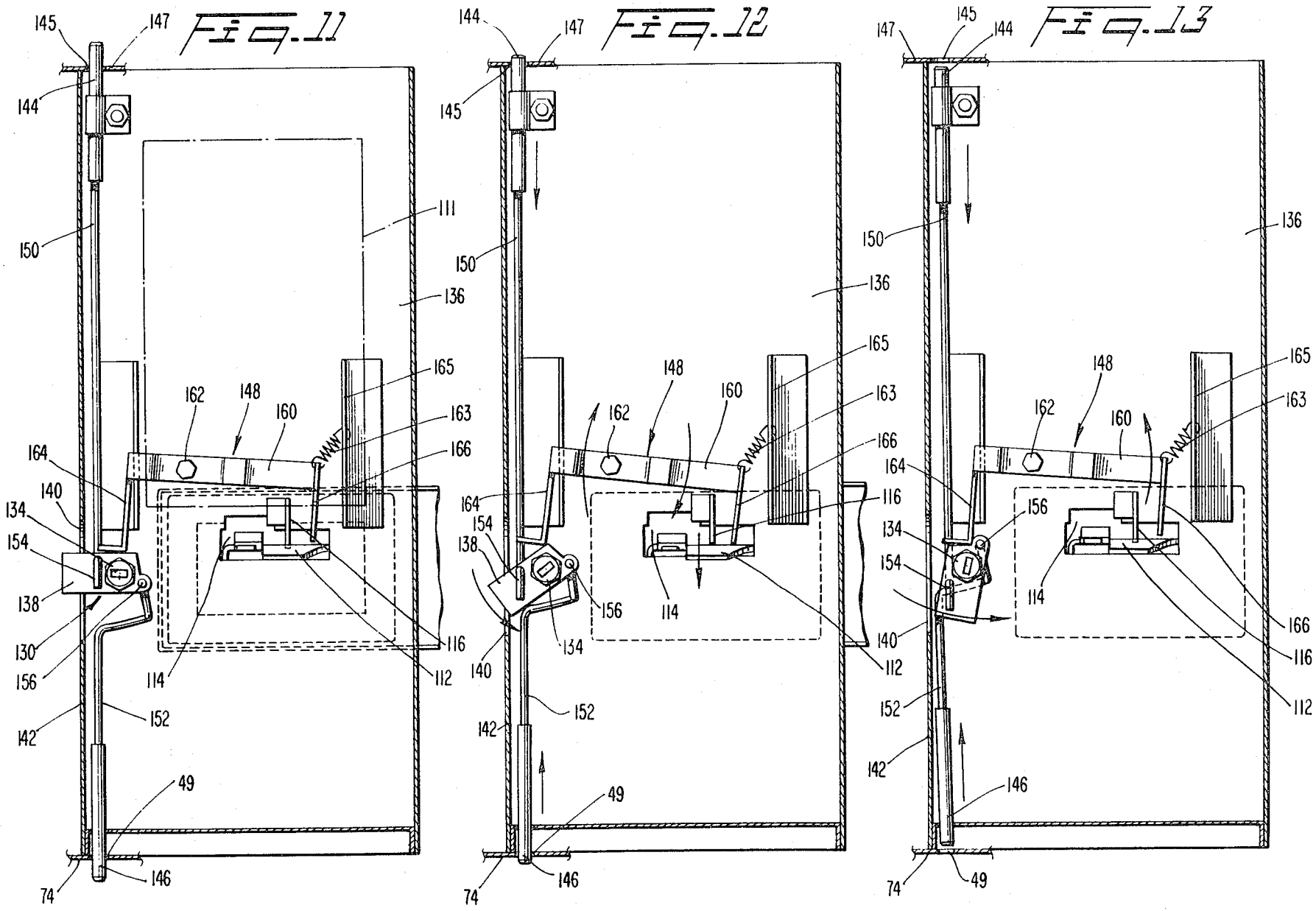
Figure 14:
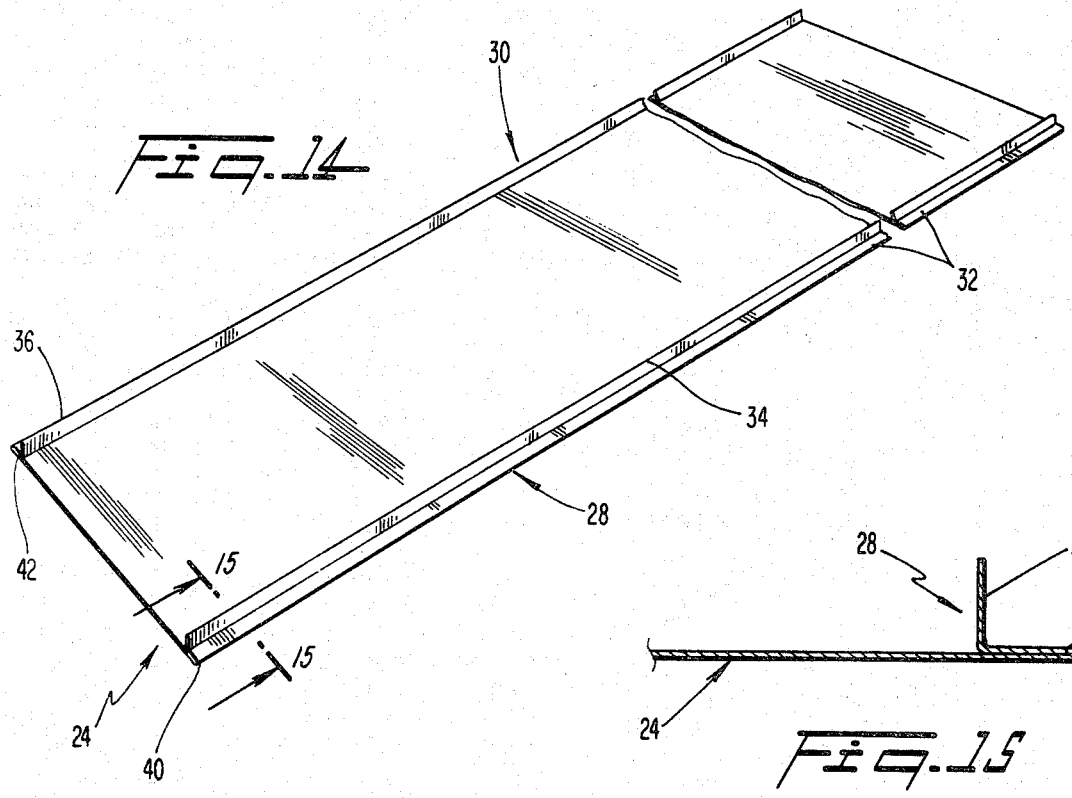
Figure 15:
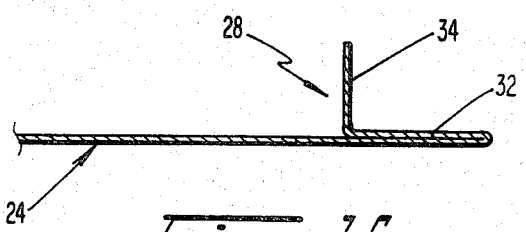
Figure 16:
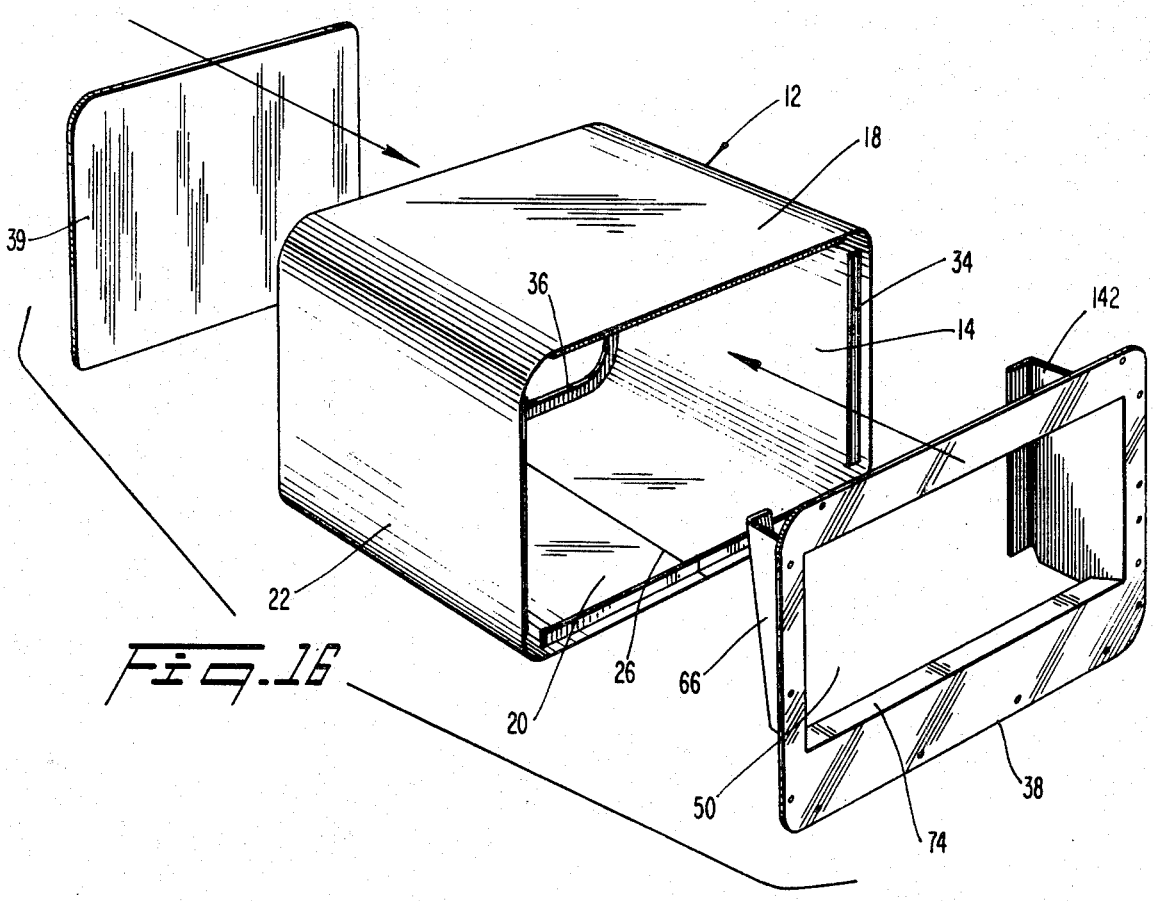

FIGS. 7–10 are horizontal sectional views similar to FIG. 6, depicting various conditions of the display machine; FIG. 7 depicts both access doors closed; FIG. 8 depicts the paper access door opened; FIG. 9 depicts the service access door in the process of being opened; FIG. 10 depicts the service access door being removed from the housing;

FIGS. 11–13 are vertical cross-sectional views taken through one side of the machine housing to depict various positions of the locking mechanism from the back looking forward; FIG. 11 corresponds to FIG. 7 wherein both access doors are locked; FIG. 12 corresponds to FIG. 8 wherein the paper access door is unlocked and opened and the service access door is locked; FIG. 13 depicts the paper access door locked and the service access door unlocked;

FIG. 14 is a perspective view of a piece of sheet metal which is to be formed into the shape of the machine housing;

FIG. 15 is a cross section taken through line 15—15 in FIG. 14; and FIG. 16 is an exploded view depicting the metal piece of FIG. 14 after it has been bent to form a rectangular enclosure, and front and rear walls which complete the housing.

DETAILED DESCRIPTION OF A PREFERRED EMBODIMENT OF THE INVENTION

A newspaper display machine 10 according to the present invention includes a housing 12 which forms an interior compartment 14. A door assembly 16 is movably hinged to the housing 12 to provide access to the interior compartment.

The housing (FIG. 16) comprises a top wall 18, a bottom wall 20, and a pair of side walls 22. These walls are formed by a single piece of sheet metal 24 (FIG. 14) which is bent along four bend lines parallel to end edges 29, 31 of the metal piece. The end edges 29, 31 are then welded together to form a single seam 26 along the bottom wall 20.

Front and rear side edges 28, 30 (FIG. 15) of the sheet metal are reverse bent inwardly by 180° at 32, with the innermost end of each reversely bent section being bent perpendicularly to the plane of the respective wall at 34 in order to form front and rear flanges 34, 36 for the attachment of front and rear walls 38, 39 to the bent piece of sheet metal, as depicted in FIG. 16. The flanges 34, 36 can be cut-away at the four bend lines to facilitate the bending of the metal piece along the four bend lines.

The vertically oriented front and rear flanges 34, 36 are spaced slightly slightly inwardly from the associated outer edges 40, 42 of the sheet metal. The rear wall 39 is preferably welded to the rear flange 36, whereas the front wall 38 is preferably secured by rivets to the front flange 34. It has been heretofore conventional to provide flanges similar to flanges 34 along the front of the housing for securement of a front wall, but not along the back of the housing. By providing the rear flanges 36, the back wall 39 can be welded to the housing such that any potential rustable areas are disposed to the inside of the housing so that no rust coloration will bleed through to the outside as is the case in conventional display machine housings.

A ground-support pedestal 46 is suitably attached to the bottom wall 20, e.g., by means of bolts (not shown). An insert plate 47 is mounted on the bottom wall 20 within the interior compartment 14 and has its edges bent inwardly and upwardly to form upstanding ribs 49. Newspapers placed upon the ribs will be spaced above the bottom wall 20 and above any moisture which may be present therein. The plate 47 is secured to the housing by means of bolts 51 located on the opposite sides of the seam 26, which bolts could, if desired, be the same bolts which secure the pedestal to the housing. If the weld seam 26 should break, the end edges of the housing will continue to be held together by the bolted plate 47.

Figure 1:
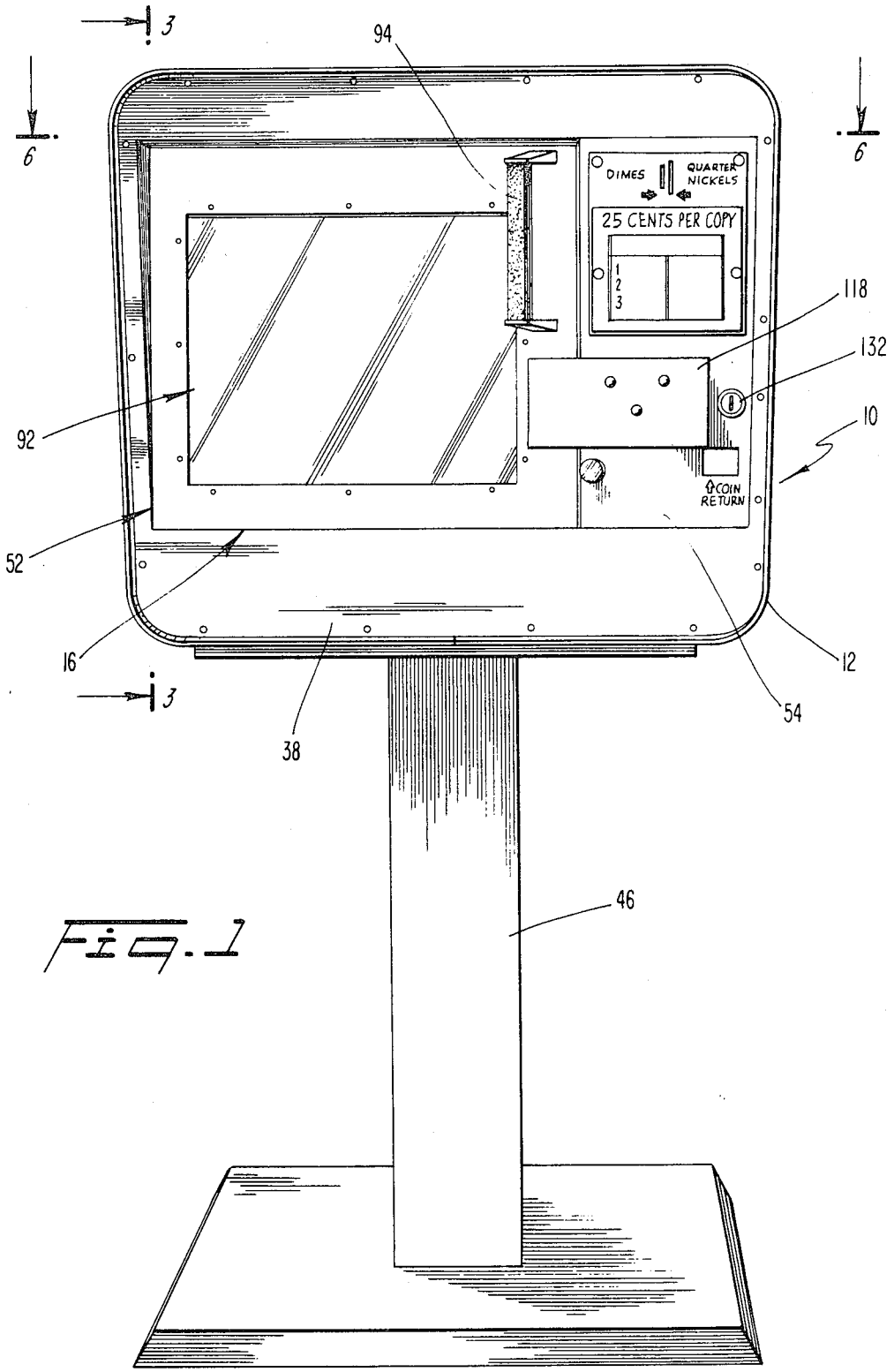
FIG. 1 is a front elevational view of a newspaper display machine according to the present invention, with the access doors each in a closed condition.
Figure 2:
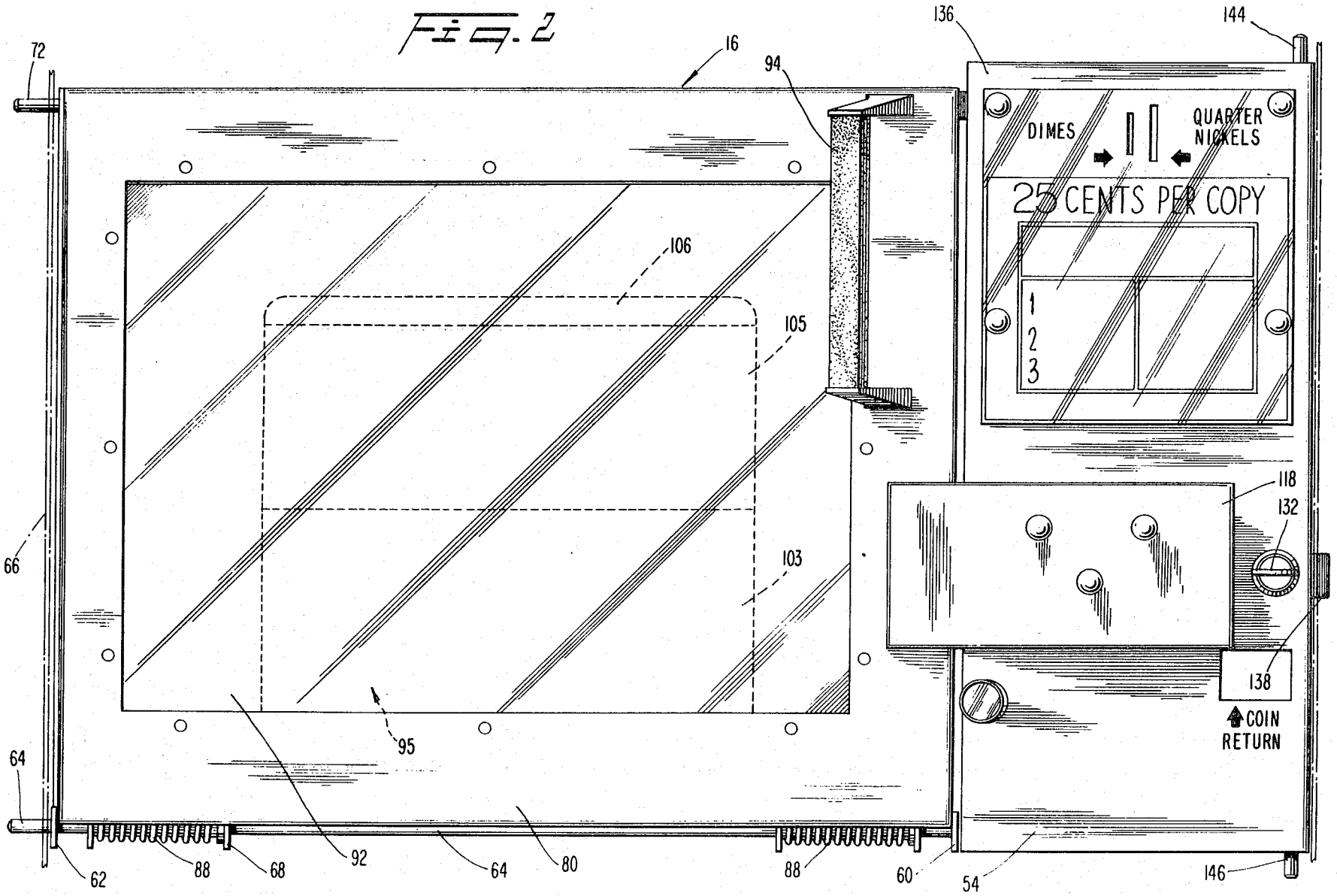
FIG. 2 is a front elevational view of the access doors.

The front wall 38 includes an access opening 50. Releasably connected to the front wall 38 across the opening 50 is the door assembly 16. The door assembly 16 (FIG. 2) includes a service access door 52 and a secondary or paper-access door 54 disposed across a secondary access opening in the service door 52.

The service door 52 swings open and closed about a vertical axis at its left-hand edge as the door is viewed from the front. The paper access door 54 swings open and closed about a horizontal axis located along its bottom edge. The paper access door 54 is inclined upwardly and rearwardly relative to vertical in its closed condition.

Figure 3:
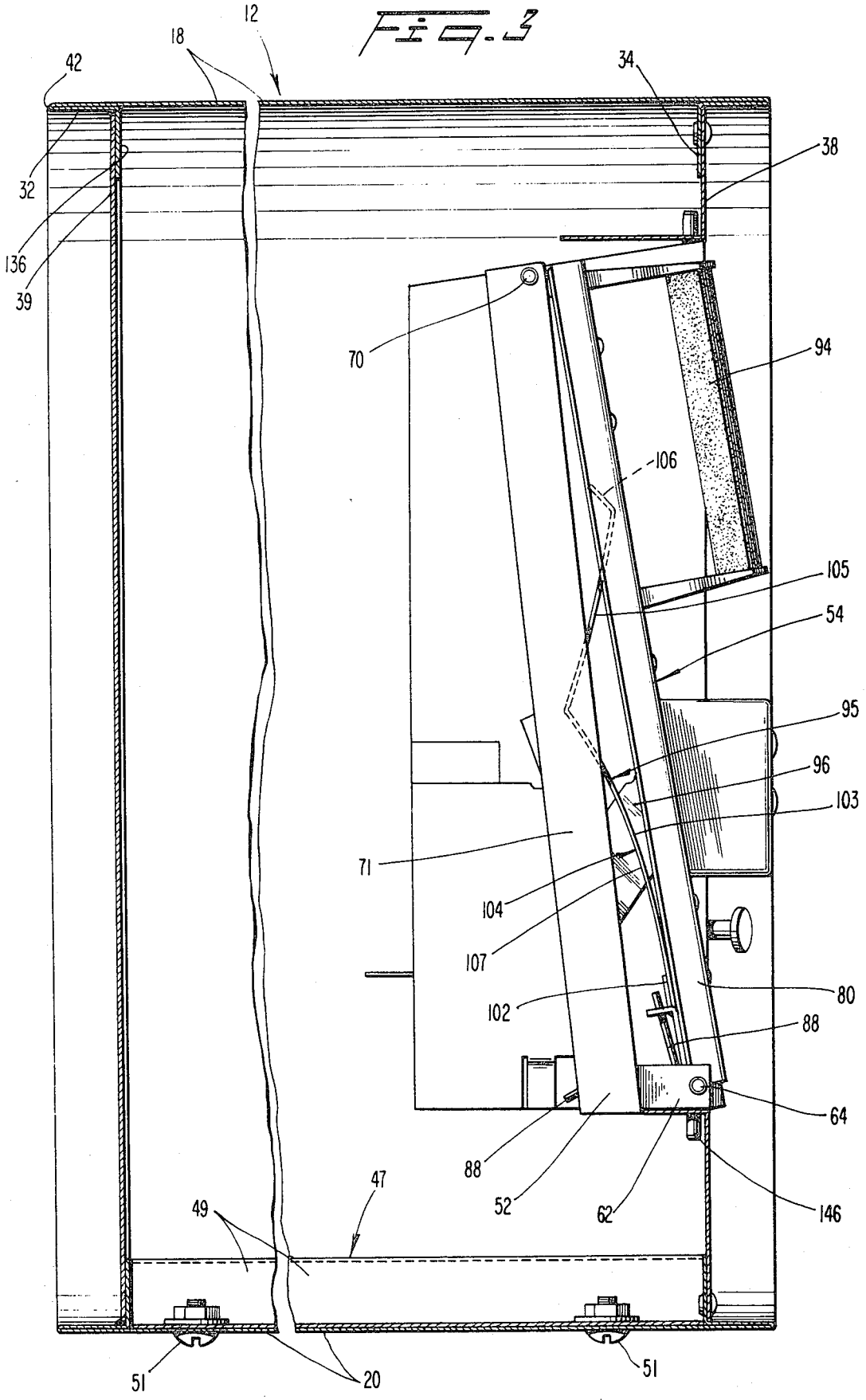
FIG. 3 is a vertical sectional view taken through the machine housing along lines 3—3 in FIG. 1.
Figure 5:
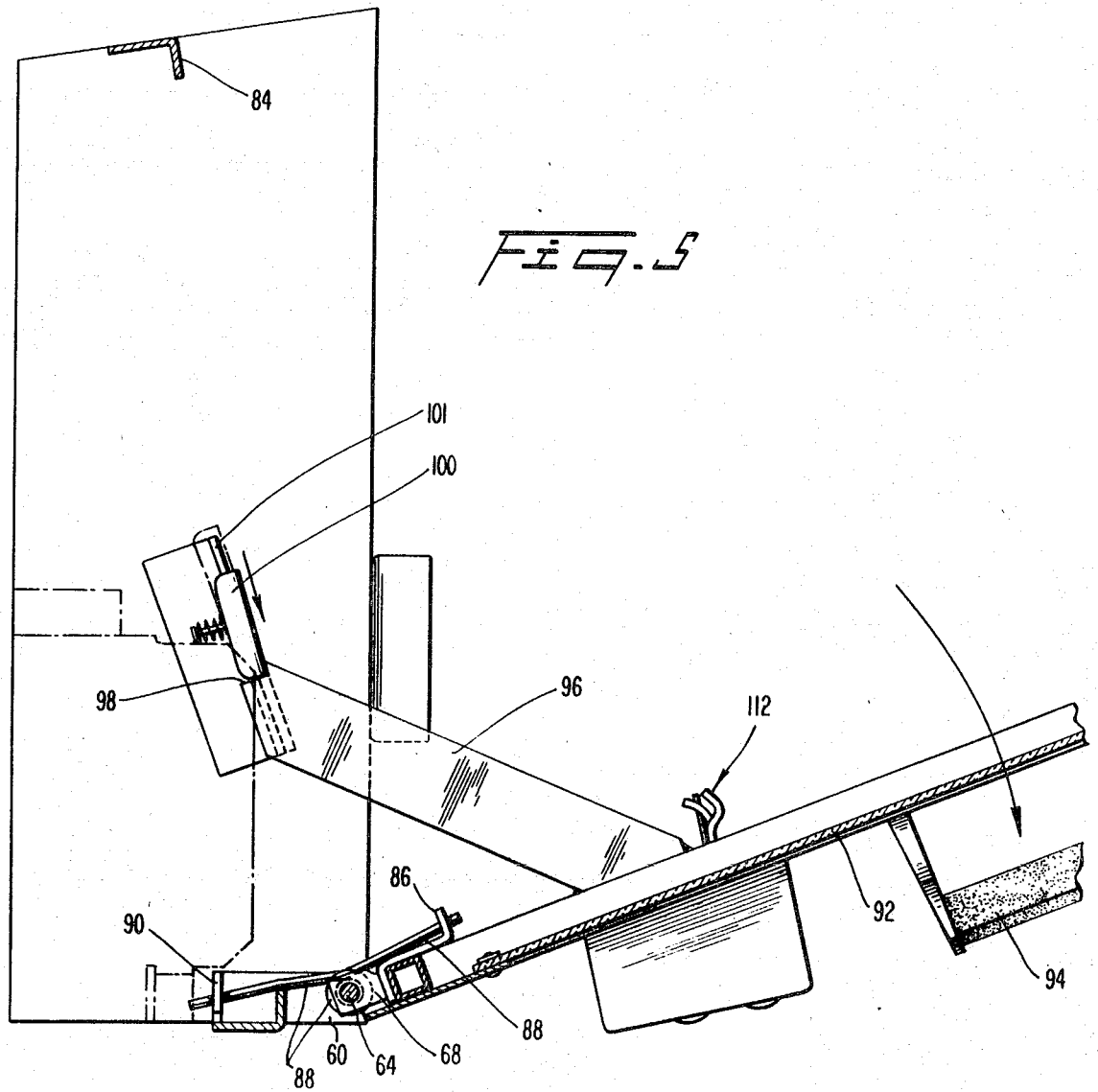
FIG. 5 is a view similar to FIG. 4, taken after the paper access door has been opened and retained open by a stop.

The service door 52 includes a pair of horizontally spaced flanges 60, 62 (FIGS. 4 and 3) near the bottom edge of the paper access door 54. Opposite ends of an elongated hinge pin or rod 64 are mounted in holes in the flanges 60, 62. The left-hand end of the pin 64 is also mounted in a hole located in a frame plate 66 of the housing 12. The pin 64 defines the hinge axis for the paper access door 54, the latter including ears 68 (FIGS. 5, 8) through which the pin 64 extends. Thus, the paper access door is rotatable about the axis of the pin 64.

The service door 52 also includes a frame part 71 which carries a horizontal pin 72 (FIGS. 3, 8) located at the upper left-hand side of the service door. This pin 72 is situated above and rearwardly relative to the lower pin 64.

The upper pin 72 is received in a hole in the frame plate 66 of the housing 12 (FIG. 8). The pins 64, 72 support the service door 52 within the housing 12 when the service door 52 is in a closed condition. The lower pin 64 defines the vertical pivot axis for the service door 52. That is, the hole in the frame plate 66 in which the lower pin 64 is mounted is of a slightly larger diameter than the lower pin 64, allowing the service door 52 to be swung open and closed about a vertical axis extending through the lower pin 64 and its mounting hole. As the service door 52 swings open, the upper pin 72 pulls out of its mounting hole. When the service door 52 is fully open, it is supported by the lower pin 64 and also by means of a bottom ledge 74 of the frame aperture 50 upon which the frame parts 71, 62 of the service door may rest. In this position, various internal mechanisms of the machine can be serviced and/or the coin box can be emptied. If it is desired to remove the service door 52 for replacement or repair, it is merely necessary to pull the bottom pin 64 from its mounting hole, as depicted in FIG. 10.

It will be appreciated that the horizontal swinging axis of the paper access door and the vertical swinging axis of the service access door are each defined by the pin 64.

Figure 4:
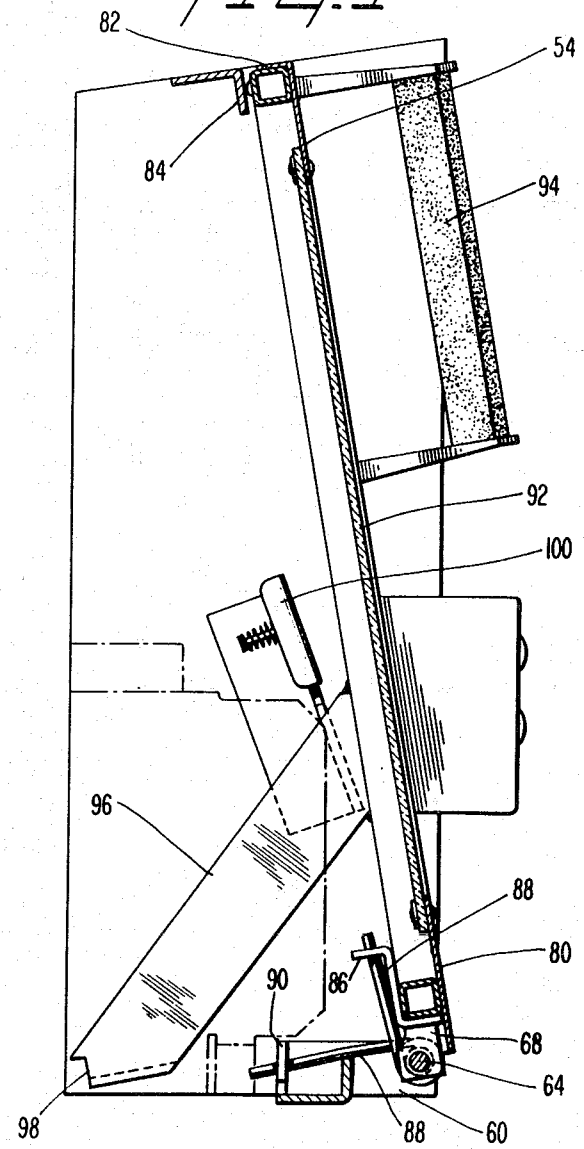
FIG. 4 is a vertical sectional view similar to FIG. 3, but taken closer to the right-hand side of the housing.

As noted earlier, the paper access door 54 carries ears 68 which mount the paper access door 54 to the service door 52. Those ears 68 are mounted to a rectangular frame portion 80 of the paper access door 54. An upper horizontal portion 82 of the rectangular frame portion 80 bears against a horizontal crossbar 84 of the service door when the paper access door 54 is in a closed position (FIG. 4).

The rectangular frame portion 80 also carries brackets 86 (FIG. 5) in which are mounted one end of a pair of torsion springs 88. The other ends of the springs 88 are mounted in brackets 90 carried by the service door 52. The springs 88 bias the paper access door to a closed position. The rectangular frame portion 80 also carries a transparent panel (e.g., plastic or glass) which forms a window 92 to enable a display newspaper mounted by a holder 95 (FIG. 3) on the inside of the paper access door to be viewed by a purchasor. A handle 94 is mounted on the frame portion 80 to enable the paper access door to be pulled open.

The paper access door 54 can be held in an open position to enable authorized personnel to remove unsold newspapers and insert current newspapers. This is accomplished by means of a stop arm 96 mounted on the rectangular frame portion 80. The stop arm 96 has a notch 98 formed therein which is adapted to receive a movable stop element 100 slidably carried on a rod 101 by the service door 52 (see FIGS. 4, 5, 8).

The holder 95 for supporting a display newspaper behind the window 92 is anchored in cantilever fashion to the door, e.g., it is affixed at its lower end to the door. In particular, a metal plate 102 is affixed rigidly to a lower portion of the paper access door 94 (FIGS. 3, 8) and a transparent plastic plate 103 is riveted or otherwise rigidly secured to the metal plate 102. The plastic plate includes a lower portion 104 inclined rearwardly away from the window 92 and an upper portion 105 extending toward the window 92. The upper portion 105 terminates in an angled lip 106. The plastic plate is yieldably biased toward the window 92 and is inherently flexible resiliently away from the window to enable a folded display newspaper to be placed between the window and the holder. Upon release, the plastic plate 103 rebounds toward the window to press the display paper thereagainst, especially at the upper portion 105 and lower portion 107 of the plastic plate. Thus, the upper and lower portions of the exposed page of the display paper are pressed against the window in a manner minimizing any distortions of the display paper and making it easier to be read through the window.

The paper access door 54 carries a securing bracket 112 (FIGS. 5, 11) which enters a slot 114 in the service door 52 and is held against withdrawal by a fixed stop finger 116. The bracket 112 is mounted on a horizontal extension 118 (FIG. 2) of the frame portion 80 of the paper access door 54. The bracket 112 is pivotably mounted to the extension for rotation about a horizontal axis and is biased upwardly by a torsion spring (not shown). The particular shape and mounting of the bracket 112 is conventional and is disclosed, for example, in the present inventor's U.S. Pat. No. 3,870,136, the disclosure of which is incorporated herein by reference.

When the paper access door 54 is closed, a curved deflecting portion 120 of the bracket 112 engages and is cammed downwardly by the stop finger 116, allowing the bracket 112 to pass therebeneath and enter a hole 121 in the bracket 112. If the paper access door is thereafter pulled upon in an effort to open same, the stop finger engages a side of the opening to prevent the paper access door from being opened. In order to enable the paper access door to be opened, it is necessary to displace the bracket 112 downwardly, whereby the bracket can pass beneath the stop finger 116. Such downward movement of the bracket can be achieved in a conventional manner by means of a coin-actuated unlocking mechanism 111 (FIG. 11) wherein a deposited coin bears against an opening cam 122 of the bracket 112 to force same open when the paper access door is pulled upon, as is disclosed in the aforementioned U.S. Pat. No. 3,870,136.

In accordance with the present invention, there is provided in combination with the conventional coin-actuated mechanism, a key-operated unlocking mechanism 130 which is able to selectively unlock the access doors 52, 54. This is achieved by means of a single key 131 insertable within a single key cylinder 132. That is, it is unnecessary to insert keys into separate locks to accomplish this result.

The cylinder 132 is mounted in a face plate 136 of the service door 54, and is adapted to receive a notched key to activate the tumblers as is conventional.

Fixedly mounted on an inside portion of the cylinder, i.e., located interiorly of the main door is an actuating arm 138. The arm 138 is aligned with a slot 140 in a side plate 142 of the front wall 38 of the housing 12 so as to be extendable therethrough. In such a position (FIGS. 11 and 12), the access doors 52, 54 cannot be opened. That is, the arm 138 locks the service door 52 and the finger 116 locks the paper access door 54.

The arm 138 is arranged to selectively actuate (i) a pair of latches 144, 146 which also lock the service door 52, and (ii) a mechanism 148 for unlocking the paper access door 54. The latches 144, 146 comprise the ends of rods 150, 152 and project, respectively, into holes 145, 149 in the lower ledge 74 and an upper ledge 147 of the front wall 38 of the housing 12. The opposite ends 154, 156 of the rods 150, 152 are mounted in holes of the arm 138. The arrangement is such that as the arm 138 is rotated from its fully locked position of FIG. 11, the latches 144, 146 are moved inwardly and away from locking engagement with the holes 145, 149. In practice, only one of the rods 150, 152 will likely be employed. If both rods are employed, the locking function of the arm 138 could be dispensed with.

The paper access door opening mechanism 148 comprises a lever 160 which is pivoted to the face plate 136 of the main door 52 by a pivot pin 162 for rotary movement within a vertical plane. A coil spring 163 is connected between the lever 160 and a bracket 165 on the face plate 138 to bias the lever to a neutral position in which the paper access door remains locked. Mounted on one end of the lever 160 is a cam follower 164, and on the other end is mounted a push pin 166. The cam follower 164 rests against the actuator arm 138 so as to be cammed thereby when the arm 138 is rotated. When the arm 138 is rotated in its unlocking direction, i.e., counterclockwise in FIG. 11, the follower 164 is cammed in a manner causing the lever to rotate 160 in a direction (i.e., clockwise in FIG. 12) which lowers the push pin 166 against the securing bracket 112 of the paper access door 54. As a result, the securing bracket 112 is pushed donwardly to an unlocking position (FIG. 12), whereby the stop finger 116 is disengaged from the hole 121 in the securing bracket 112. Thus, the paper access door 54 may be pulled open (see FIG. 8).

In the paper access door-unlocking position in which the latch 112 is unlocked (FIG. 11), the service door remains locked since the actuating arm 138 remains disposed within the slot 140, and the latches 144, 146 remain disposed within the holes 145, 149. In response to further rotation of the actuating arm 138, the latter is withdrawn from the slot 140, and the latches 144, 146 are withdrawn from the holes 145, 149 (FIG. 12), enabling the service door 52 to be swung open. As the arm 138 is swung from the paper access door unlocking position (FIG. 12) to the service door unlocking position (FIG. 13), the lever 160 is reverse-rotated to its position of FIG. 11, whereby the paper access door will be held locked. In this position, the handle 94 on the paper access door can be employed to swing-open the service access door.

It will be appreciated that during normal use of the display machine, the paper access door will be repeatedly opened and allowed to slam shut under the influence of the spring 88. If the service access door is not properly supported, the forces created by the slamming action can eventually deform the unsupported portions of the service door. In the present invention, the service door 52 is supported at least at four spaced locations, i.e., by means of the pins 64 and 72, the arm 138, and either of the rods 144, 146 (if only one is employed). Thus, rearward forces imposed upon the service access door by the paper access door are resisted at those four locations spaced around the periphery of the service access door to resist deforming thereof.

IN OPERATION, the display machine 10 is disposed with the lock 132 in a first position (FIG. 11) wherein the paper access door 54 is locked by the stop finger 116, and the service access door 52 is locked by the arm 138 and the rods 144, 146. Purchasers obtain papers by depositing coins in the coin-actuated unlocking mechanism 111. The latch 112 of the paper access door 54 is cammed open as a consequence, and the purchasor opens the paper access door by means of the handle 94. The purchaser was previously able to view the display paper seated behind the window 92, which paper was easily read since the upper and lower ends of the paper are pressed against the window by the elastic holder 95. If no display paper is present, the interior compartment can be viewed by the purchaser since the holder 95 is transparent.

When the purchaser releases the paper access door, following the removal of a paper, that door is slammed shut by the spring 88. The resulting forces imposed upon the service access door 52 are effectively resisted by the multiple, mutually spaced supports defined by the pins 64 and 72, the arm 138, and one or both of the rods 144, 146.

When authorized personnel needs to replace the newspapers, a key 131 is inserted into the lock 132 and turned to position the locking mechanism 130 to the second position (FIG. 12) in which the service access door remains locked and the paper access door is unlocked. This enables the paper access door to be opened by pulling upon the handle 94.

If it is necessary to open the service access door to service the coin-actuated unlocking device or collect coins, the same key is further rotated to shift the locking mechanism to its third position (FIG. 13) wherein the paper access door is locked and the service access door is unlocked. Thus, by pulling on the handle 94, the service access door is opened about a vertical axis defined by the pin 64, which pin also defines the horizontal axis about which the paper access door 54 is opened. If it is necessary to remove the service access door from the housing it is merely necessary to slide the pin 64 from the housing (FIG. 10).

It will be appreciated from the foregoing that the display machine of the present invention offers numerous advantages. For example, the paper access door and service access door can be selectively unlocked by a single key-operated lock, thereby eliminating the need for authorized personnel to carry and manipulate two keys.

The service access door is supported at least at four locations around its periphery to effectively resist the impacts imposed by the paper access door as it is slammed shut.

A paper holder is provided which presses upper and lower ends of a display newspaper against the viewing window to minimize distortions of the latter, thereby making the paper easier to read from the outside. The holder is transparent to enable the interior compartment to be viewed if the display paper is not present.

The housing of the display machine is formed with only a single seam located along a bottom surface of the housing. This greatly simplifies the fabrication of the housing since its easier to align the single pair of edges rather than to align multiple pairs of edges as is necessary, for example, when assembling two U-shaped housing sections. Also, the seam is not exposed to the elements and is thus less susceptible to rusting. Since the sides and top of the housing contain no seams, the overall appearance of the housing is enhanced. Moreover, even if the single seam of the present invention becomes broken, the housing will still be held together by the bolted plate 47.

Although the present invention has been described in connection with a preferred embodiment thereof, it will be appreciated by those skilled in the art that additions, modifications, substitutions, and deletions not presently claimed may be made, without departing from the spirit and scope of the invention as defined in the appended claims.

What is claimed is:

1. A display machine of the type including a coin-actuated unlocking device, said display machine comprising:

a housing defining an interior compartment for containing articles to be sold, said housing forming a main access opening, a first door movably mounted on said housing for opening and closing said access opening, said first door forming a secondary access opening, first locking means for locking said first door to said housing, a second door carried by said first door and being movable relative thereto for opening and closing said secondary access opening, second locking means for locking said second door to said first door and being arranged to be unlocked in response to the insertion of appropriate coinage in said coin-actuated unlocking device, and a key-actuated unlocking mechanism mounted on said first door and operably connected to said first and second locking means and being movable between three separate positions in response to key actuation, said unlocking mechanism including means for maintaining said first and second locking means in their locking positions, when said unlocking mechanism is in a first of said three positions, means for unlocking said second locking means while maintaining said locking means in its locking position, when said unlocking mechanism is in a second of said three positions, and means for unlocking said first locking means, and maintaining said second locking means in its locking position, when said unlocking mechanism is in a third of said three positions.

2. A display machine according to claim 1, wherein said key-actuated unlocking mechanism includes a rotary cylinder operably connected to said first and second unlocking means.

3. A display machine according to claim 2, wherein said first locking means includes an arm operably connected to said cylinder and receivable within a slot of said housing.

4. A display machine according to claim 2, wherein said second locking means comprises a movable bracket mounted on said second door and a stop finger affixed to said first door, said bracket and finger being interengageable when said second door is closed, said unlocking mechanism including means operably connected to said cylinder and engageable with said bracket for moving said bracket out of engagement with said finger in said second position of said locking mechanism.

5. A display machine according to claim 4, wherein said first locking means includes an arm operably connected to said cylinder and receivable within a slot in said housing, said arm being disposed in said slot while said locking mechanism is in said second position, said arm being movable out of said slot in response to movement of said unlocking mechanism to said third position.

6. A display machine according to claim 3, wherein said first locking means further comprises at least one pin receivable in a hole in said housing and means connecting said pin to said arm for moving said pin out of said hole in response to movement of said arm out of said slot.

7. A display machine according to claim 5, wherein said unlocking mechanism comprises a lever pivotably mounted on said first door, one end of said lever carrying said means which is engageable with said bracket, another end of said lever carrying a cam follower which rides upon said arm and is cammed thereby when said arm is rotated by said cylinder.

8. A display machine according to claim 7, wherein said first locking means further comprises at least one pin receivable in a hole in said housing and means connecting said pin to said arm for moving said pin out of said hole in response to movement of said arm out of said slot.

9. A display machine according to claim 1, wherein said second door includes a window, a holder on an inner side of said second door for retaining a display newspaper against said window to be viewed from the outside, said holder being yieldably biased toward said window and being manually displaceable away from said window against said bias to permit a display newspaper to be positioned between said holder and said window, said holder including means for engaging upper and lower portions of said display newspaper so that upon release of said holder, the latter rebounds toward said window to press the upper and lower portions of the display newspaper against said window.

10. Apparatus according to claim 9, wherein said holder is anchored in cantilever fashion adjacent its lower end to be flexible toward and away from said window.

11. A display machine according to claim 1, including a spring for biasing said second door closed, said first door carrying at least four projecting elements which abut against said housing at spaced locations around the periphery of said first door to resist inward forces imposed against said first door by said second door when the latter is slammed shut by said spring.

12. Apparatus according to claim 11, wherein said projecting elements comprise a first pin disposed in a hole of said housing to define an axis of rotation for said first door, a second pin disposed in a second hole of said housing, and a pair of movable locking projections, one of which locking projections defines said first locking means.

13. A display machine according to claim 1, wherein said housing comprises a piece of elongate sheet metal having two elongate parallel side edges and two parallel end edges interconnecting said side edges, said piece of metal being bent in four places parallel to said end edges to form a seamless top surface, and two seamless side surfaces, said end edges being welded together to form a single-seamed bottom surface, and front and back walls secured to said bent piece of metal adjacent respective ones of said side edges.

14. A display machine according to claim 13 including a plate attached to the inside of said bottom surface by means of fasteners disposed on opposite sides of the single seam.

15. A display machine comprising:

a housing forming an interior compartment for containing items to be vended, a first access door hingedly mounted on said housing to afford access to said interior compartment, said first door having four edges, a coin-actuated second door hingedly mounted on said first door for providing access to said interior compartment, a coin-actuated mechanism carried by said first door for unlocking said second door, and a spring biasing said second door toward a closed condition, said first door carrying at least four mutually spaced projecting elements located on at least three of said edges and which abut against said housing at spaced locations around the periphery of said first door to resist inward forces imposed against said first door by said second door when the latter is slammed shut by said spring.

16. Apparatus according to claim 15, wherein said projecting elements comprise a first pin disposed in a hole of said housing to define an axis of rotation for said first door, a second pin disposed in a second hole of said housing, and a pair of movable locking projections.

17. Apparatus according to claim 14, wherein two of said projecting elements are movably mounted on said first door and are key-actuated for such movement.

18. A display machine for publications, comprising a housing in the form of a piece of elongate sheet metal having two elongate parallel side edges and two parallel end edges interconnecting said side edges, said piece of metal being bent in four places parallel to said end edges to form a seamless top surface, and two seamless side surfaces, said end edges being welded together to form a single-seamed bottom surface, and front and back walls secured to said bent piece of metal adjacent respective ones of said side edges, said back wall being solid to close off the back of said housing and said front wall including an opening, and an operable door disposed across said opening, said door incuding a window therein.

19. Apparatus according to claim 18, wherein said side edges each comprise a section of said metal piece which is folded-back 180 degrees inwardly toward the interior of the housing and 90 degrees laterally to form a flange to which a respective one of the front and rear walls is secured.

20. Apparatus according to claim 18, including a plate attached to the inside of said bottom surface by means of fasteners disposed on opposite sides of the single seam.

21. In a method of making a display machine for publications comprising the steps of:

providing a sheet of metal having parallel elongate side edges and parallel end edges interconnecting said side edges, bending said metal pieces at four locations parallel to said end edges to form a seamless top surface and two seamless side surfaces, welding said end edges together to form a single-seamed bottom surface, and attaching a non-solid front wall and a solid back wall to said piece of metal adjacent respective ones of said side edges to close-off the back of the housing while enabling a display machine to be inserted into an opening of said front wall.

22. A method according to claim 21, including prior to said bending step, the steps of folding each of said side edges at two locations perpendicular to said end edges to form a first portion lying upon said metal piece and a flange portion projecting laterally from said first portion, said bending step being performed in a manner disposing said flanges on the inside of said rectangular member.

23. A method according to claim 21, including the step of affixing a pair of walls to respective ones of said flanges to form front and rear walls of said housing.

24. Apparatus according to claim 18, including a ground support pedestal mounted to said bottom surface.

25. A method according to claim 21, including the step of mounting a ground support pedestal to said bottom surface.

26. A newspaper display machine comprising:

a housing defining an interior compartment for newspapers, a door mounted on said housing for providing access to said housing interior, said door including a transparent window, and a holder formed of transparent material mounted on an inner side of said door for retaining a display newspaper against said window to be viewed from the outside, said holder being yieldably biased toward said window and being manually displaceable away from said window against said bias to permit a display newspaper to be positioned between said holder and said window, said holder including means for engaging upper and lower portions of the display newspaper when said holder rebounds toward said window to press the upper and lower portions of the newspaper against said window, a first portion of said holder located adjacent an anchored end of said holder extending away from said window and merging with a second portion of said holder extending toward said window.

27. A display newspaper machine for newspapers and the like comprising:

a housing defining an interior compartment for newspapers, a door mounted on said housing for providing access to said housing interior, said door including a transparent window, and a holder mounted on an inner side of said door for retaining a display newspaper against said window to be viewed from the outside, said holder being yieldably biased toward said window and being manually displaceable away from said window against said bias to permit a display newspaper to be positioned between said holder and said window, said holder including means for engaging a portion of the display newspaper when said holder rebounds toward said window to press the display newspaper against said window, said holder formed of a flexible material and anchored adjacent one end in cantilever fashion to be flexible away from said window.

28. A display machine according to claim 27, wherein said portion of said holder which engages a display newspaper merges with another portion of said holder which is situated between said fist-named portion of said holder and said anchored end of said holder and which extends away from said window.

29. A display machine according to claim 27, wherein said holder is formed of a transparent material.

* * * * *